United States Patent [19]

Fink et al.

[11] Patent Number: 5,035,131

[45] Date of Patent: Jul. 30, 1991

[54] ROLL STAND FOR A PLANETARY ROLLING MILL

[75] Inventors: Peter Fink; Dieter Figge, both of Essen, Fed. Rep. of Germany

[73] Assignee: Mannesmann Aktiengesellschaft, Düsseldorf, Fed. Rep. of Germany

[21] Appl. No.: 573,853

[22] Filed: Aug. 28, 1990

[30] Foreign Application Priority Data

Aug. 29, 1989 [DE] Fed. Rep. of Germany ..... 3928962

[51] Int. Cl.[5] ..... B21B 13/20

[52] U.S. Cl. ..... 72/190; 72/238; 72/240

[58] Field of Search ..... 72/190, 191, 194, 197, 72/237, 238, 240, 413

[56] References Cited

U.S. PATENT DOCUMENTS 2,932,997 4/1960 Sendzimir ..... 72/190
2,960,894 11/1960 Platzer ..... 72/190
3,522,720 8/1970 Sendzimir ..... 72/240

FOREIGN PATENT DOCUMENTS 0316072 5/1989 European Pat. Off. ..... 72/190
2556974 6/1977 Fed. Rep. of Germany ..... 72/191

*Primary Examiner*—Lowell A. Larson
*Assistant Examiner*—Thomas C. Schoeffler
*Attorney, Agent, or Firm*—Cohen, Pontani & Lieberman

[57] ABSTRACT

To substantially increase the periods of time between the changing of rolling segments and to reduce the amount of work connected therewith in a roll stand for a planetary rolling mill, chocks in which stationary support bodies having rolling segments are mounted are provided with a square or octagonal disk shape, and each support body, instead of having one rolling segment as known heretofore, is provided with four or eight rolling segments distributed uniformly on its periphery. A turnable rolling ring is, further, provided at each end of each support body.

12 Claims, 5 Drawing Sheets

ROLL STAND FOR A PLANETARY ROLLING MILL

BACKGROUND AND SUMMARY OF THE INVENTION

The present invention relates to a roll stand for a planetary rolling mill of the type having stands, stationary support bodies with rolling segments mounted in chocks, and intermediate and work rolls mounted in cages and rotating around the support bodies.

In a planetary rolling mill of the foregoing type, known as a Platzer planetary rolling mill after its inventor, the working rolls are brought to rest, upon rotation around the stationary support members in opposition to a centrifugal force, against the intermediate rolls and the latter are brought to rest against the support bodies. The surface of the support bodies represents, except for a small region of the shaping zone, a precise cylindrical surface. Within this region of the shaping zone, the rolling surface differs from an exact circular shape in order to assure a dependable, i.e. groove-free, surface of the stock rolled. This roll geometry differs from a precise cylinder surface, produced, for reasons of wear, by means of rolling segments inserted in the support bodies. These rolling segments, which form the rolling path for the intermediate rolls, are made of hardened steel and are fastened replaceably in recesses in the support body.

The rolling segments are subjected to very high mechanical loads since in the shaping zone the radial rolling forces in the stationary support bodies are conducted over them. During the shaping, upon the rolling of the supporting rolls on the rolling segment, high hertzian pressures are produced. With 24 support rolls per cage, each rolling segment is rolled over 24 times upon each rotation of the cage.

With a customary cage speed of rotation of 120 rpm and a load of about 85 t there results a life of a segment of about 25 hours. An incipient formation of grooves indicates that regrinding of the segment is necessary. For the regrinding, the set of rolls must be removed from the stand so that the rolling segment can be dismounted. Five working rolls and five backup rolls from each set must be removed before the rolling segments can be dismounted. They are fastened, for instance, by screws in the support body. The old rolling segment is removed and reworked on a surface grinding machine. Another completely reground rolling segment is installed into the set of rolls and the latter is supplemented again with the five backup and working rolls. This requires a large amount of labor and time, extensively limiting the availability of the planetary rolling mill if the rolling segments must be removed and reground after every 25 hours.

In addition to this, while it is true that in the case of smaller roll stands it is still possible to remove and install the working rolls by hand, for the handling of the rolling segments, however, a light crane is required. In the case of medium size and larger roll stands, however, in which the working rolls weigh up to 600 kg, suitable hoists are required, which leads to increased investment costs and to a lengthening of the removal and installation times.

With a production machine or installation, long standstill times are not acceptable. This applies, in particular, to systems with high investment costs. The purpose of a roll stand must therefore be to lengthen both the times between the required replacement of the work rolls and the rolling segments and to reduce the time for replacement or reinstallation.

Since, by the grinding of working rolls in an installed condition, it has been possible to substantially reduce the corresponding amount of work and increase the time between the changing of the working rolls to about 100 hours, the rolling segments with a life of about 25 hours are a determining time and cost factor.

An object of the invention is to substantially increase the times between the changing of the rolling segments and to reduce the work connected therewith.

The foregoing object is achieved in a roll stand of the aforementioned type in the manner that the chocks have a square basic shape and each support body, instead of being equipped as previously with one, is provided with four rolling segments distributed uniformly over the circumference, and is furthermore provided at each end with a rolling ring. By a roll stand developed in this manner the steps for the removal of the worn rolling segments and installation of the reground rolling segments, which are customarily necessary about every 25 hours and are very time-consuming, become superfluous.

These steps are: (i) removal of the two support bodies from the roll stand; (ii) removal of in each case five working rolls and five intermediate rolls; and (iii) replacement of the rolling segments and reinstallation in reverse sequence.

In a roll stand in accordance with the invention, those rolling segments which are in use become so worn after about 25 hours of operation that they must be replaced, even in the case of optimal heat treatment. Since the support body however is equipped with 4 rolling segments distributed uniformly on the periphery, the support bodies are merely moved out of the roll stand, turned 90°, and reinstalled upon every fourth regrinding of the work rolls, when they, in any event, must be removed.

By the provision of four rolling segments per support body which are brought into use one after the other, a further advantage is obtained. The removal and installation of in each case 5 work rolls and 5 intermediate rolls, as is otherwise necessary for the changing of the rolling segments, is dispensed with since this operation can be carried out precisely when the work rolls are finally worn out completely after 16 regrindings, i.e. such rolls have reached the smallest permissible diameter and must be replaced by new ones.

In the Platzer roll stands constructed up to the present time the working rolls are pressed against the intermediate rolls by means of packs of disk springs upon rotation around the support bodies in a direction opposite the centrifugal force, and these intermediate rolls are held in continuous contact with the cylindrical surface of the support bodies. In the region of the rolling segment with its geometry that differs from a precise cylindrical surface, the rolls are pressed by the rolling force. In the case of the roll stand of the invention, upon the customary speeds of rotation there would be, as a result of the geometry, a brief lifting followed by impact-like replacing of the intermediate rolls on the surface of the support body in the region of the three additional roll segments, and therefore wear. In the case of the invention, therefore, it is assured by a design measure that the lifting of the rolls is definitely avoided upon the rolling over of the three rolling segments which are not in engagement. For this there are suitably two rolling rings, namely one on each side of the support body. By means of these rolling rings the intermediate rolls are guided over a dependable circular path also in the region of the three rolling segments which are not in engagement, so that impact-like application of the intermediate rolls is avoided. In the working region the rolling rings have recesses so that the rolls can rest here against the flats of the rolling segments.

The chocks are of a square basic shape, as a result of which exact positioning of the rolling segments which are arranged 90°. Removal and installation of the rolling segments is unnecessary at this time as is the removal and reinstallation necessary for the purpose of, in each case, 5 working rolls and 5 intermediate rolls. The result is furthermore obtained that the replacement of the 4 pairs of worn rolling segments is effected when the working rolls must be replaced so that no additional work and installation for this expense results.

An alternative embodiment of the invention resides in the fact that the chocks are developed in an octagonal shape and each support body has eight rolling segments. This has the advantage that the time between the necessary replacement of the rolling segments can be doubled.

An advantageous further development of the invention resides in the fact that the two rolling rings of a support body can be turned by a turning device with respect to the support body and clamped against the support body by clamping means. In this way it is possible to effect, in a simple and rapid manner, the rotation of the rolling rings with respect to the support body by 90°. This rotation is necessary in order that the recesses of the rolling rings again agree with the working zone. By these means, the rolling rings are turned without removal or mounting work, under the application pressure exerted by the packs of spring disks. For turning the rolling rings, clamping devices (preferably four in number) that are arranged between the rolling segments, are loosened, by means of which the rings are clamped fast against the support bodies during operation.

The two rolling rings of each support body are advisedly turned synchronously by the required 90°. For this purpose, the rolling rings are provided with an inner toothing on the side facing the support body. Into this inner toothing there engage drive pinions that are fastened on a common shaft extending within a hole in the support body and mounted for rotation therein. The drive is effected by a drive unit with a stepping motor arranged in one of the chocks, so that precise positioning in the installed condition can be effected without measuring or a control device and without visible verification. In order to be able to keep the size of the stepping motor small, a hydraulic booster as well as a self-locking gearing is arranged between it and the pinion. This self-locking gearing (for instance, a worm gearing) has the advantage that in this way shaking loose in operating condition, i.e. a gradual overcoming of the clamping force of the clamping device, is definitely avoided.

The clamping devices are advantageously developed as clamping cylinders which are arranged in holes in the support body. The clamping force is produced by disk springs, and loosening for the turning of the rolling rings is effected by the action of pressure on the cylinder chamber. The piston rod is provided on its free end with a head or block which engages in an annular groove in the rolling segment, which groove is worked into the surface facing the support body. Upon the release of the cylinder from the load, the spring force of the disk springs holds the rolling ring firmly against the support body.

In order to make the installation and removal of the support bodies together with their chocks as simple as possible, the edge lengths or the distance apart of the side surfaces of the latter are smaller than the outside diameter of the planet set. For each chock, two ledges are provided which are screwed, corresponding to the position of installation, to the vertical side surfaces of the chocks and are correspondingly mounted upon the turning of the support body by 90°. This is the only manual action upon the turning of the support bodies.

In order to facilitate the turning in each case of the support bodies, they can be provided on each end with pivot pins which extend outward beyond the chocks. In this way, turning of the support bodies after the removal of the planet rolls from the stand by 90° is possible in a simple manner in a turning device which is located alongside the roll stand.

In a further embodiment, the chocks are provided with an octagonal basic shape, rather than a square shape, and each support body is provided with eight rolling segments distributed uniformly on its periphery, rather than four.

BRIEF DESCRIPTION OF THE DRAWING FIGURES

Further objects and advantages of the invention will become apparent from considering the following detailed description of a preferred embodiment of the invention in connection with the accompanying drawing figures, in which.

DETAILED DESCRIPTION OF THE PREFERRED EMBODIMENTS

Figure 1:
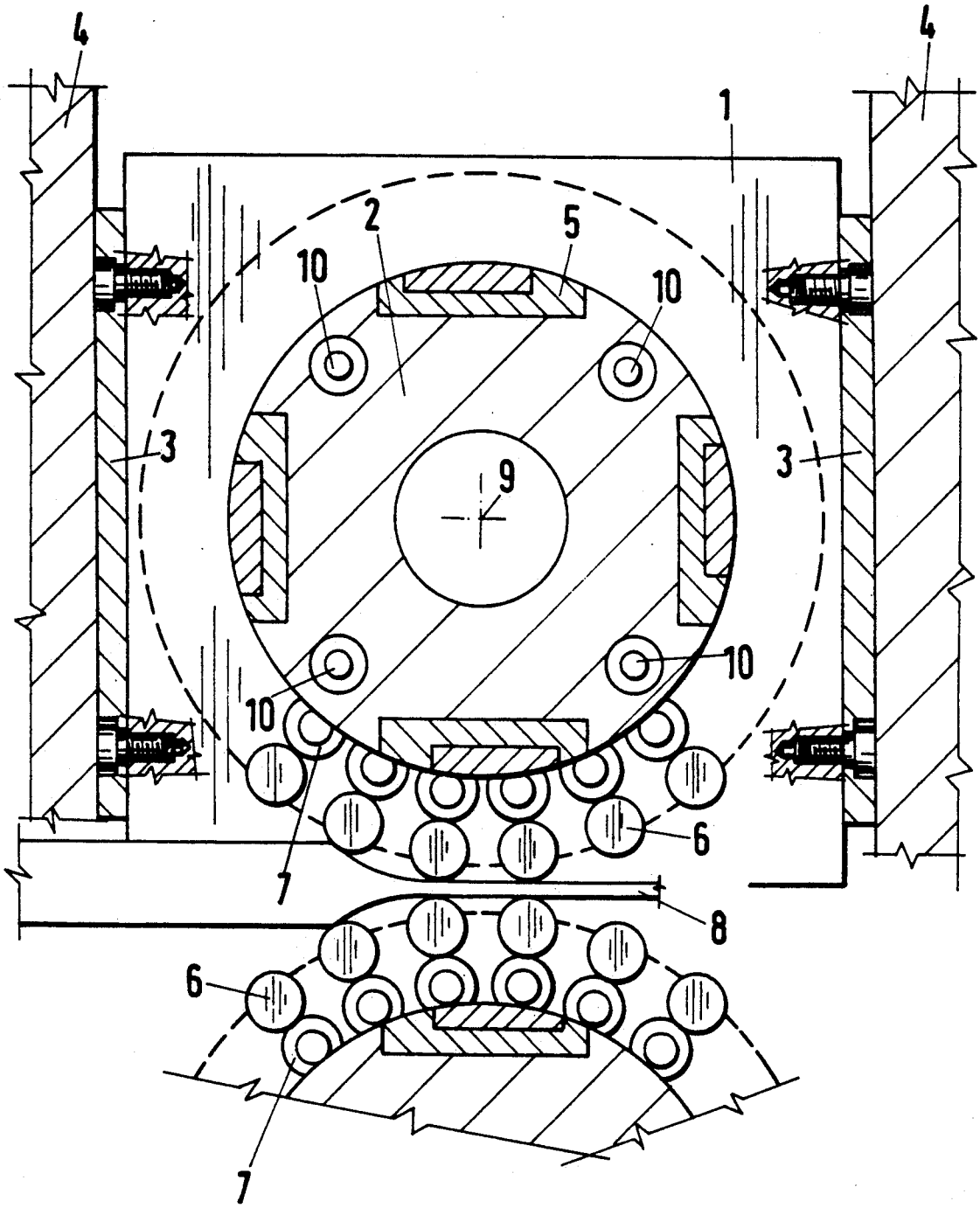
FIG. 1 is a cross section through the upper support body.

FIG. 1 shows the upper part of a planetary rolling mill in cross section. The chock 1 in which the support body 2 is held in a stand 4 is guided by ledges 3 within the stand 4. These ledges 3 are unscrewed upon the turning of the chocks 1 (by 90° apart) in the support body 2. By the fact that the geometry of the rolling segments 5 differs from a precise cylindrical shape, the work rolls 6 which rest on the intermediate rolls 7 are so guided in the roll nip that the material 8 being rolled is imparted a perfect surface. The work rolls 6 are pulled in the direction of the support-body axis 9 upon travel around the support body 2 by disk-spring packs, not shown in the drawing. The four clamping devices 10 arranged in the support body 2 lie between the rolling segments 5.

Figure 2:
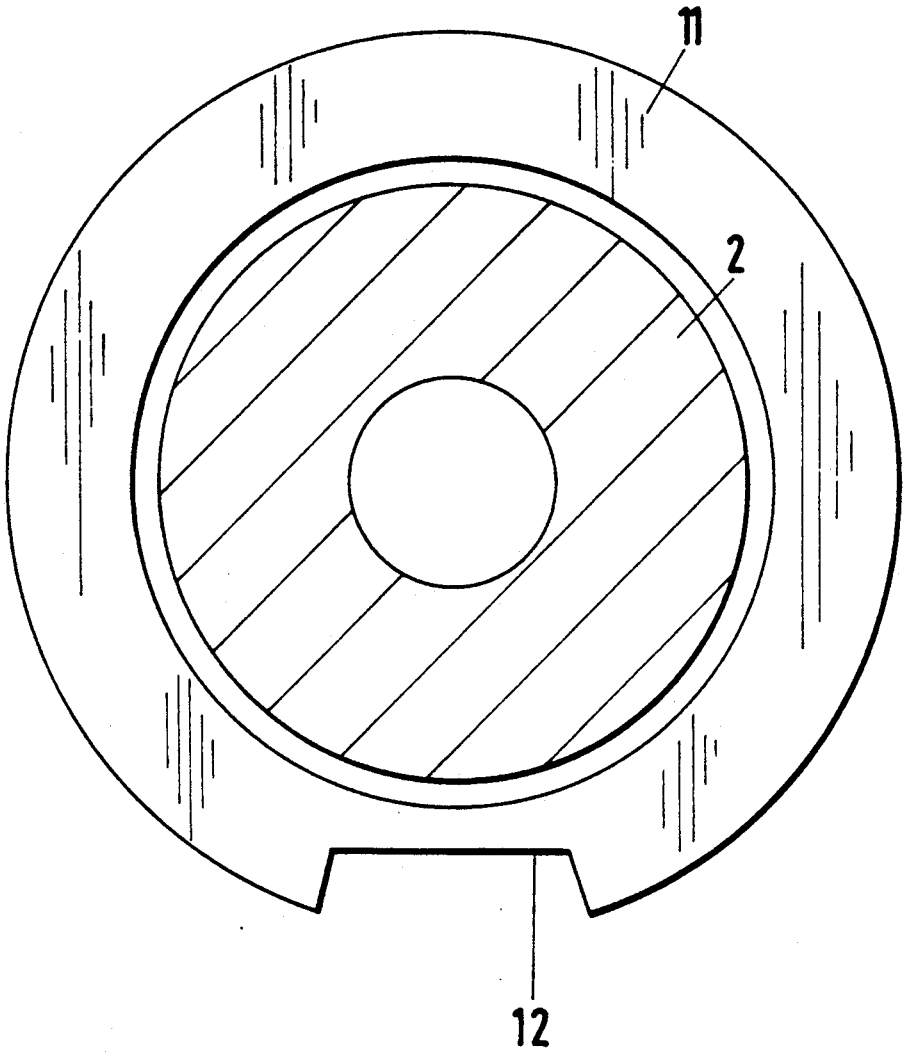
FIG. 2 is a rolling ring.

In order to prevent a lifting off and impact-like replacement of the intermediate rolls 7 upon the rolling over of the rolling segments 5 which are not in the working position, i.e. directly opposite, each support body 2 is provided on both its ends with a rolling ring 11, as shown in FIG. 2. These rolling rings 11, on which the intermediate rolls 7, roll are turnable on the support body 2, but are blocked during the rolling and have a circular profile except for a recess 12 in the region of the roll nip.

Figure 3:
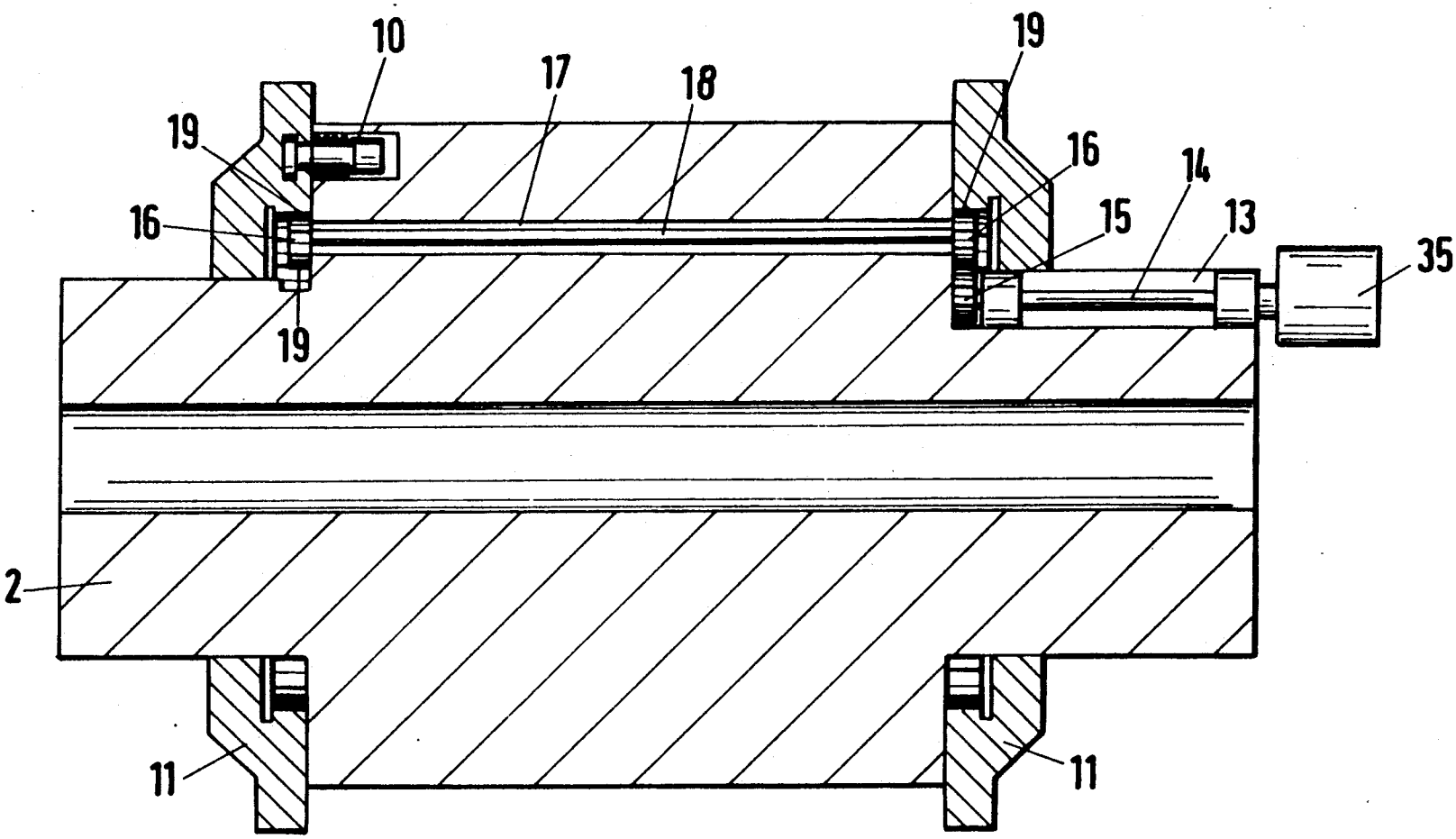
FIG. 3 is a longitudinal section through a support body with rolling rings and turning and clamping device.
Figure 6:
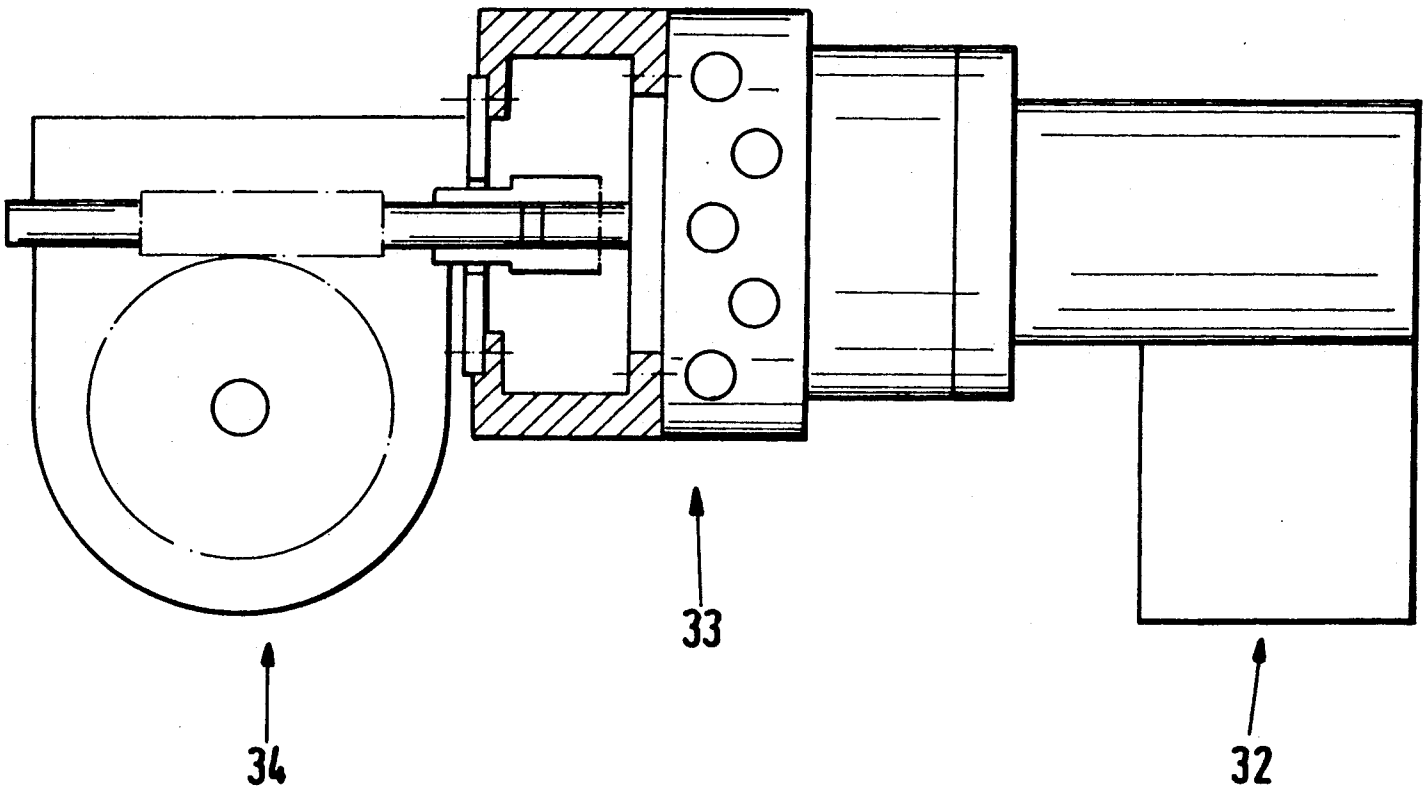
FIG. 6 shows a drive unit.

FIG. 3 shows the two devices by means of which the two rolling rings 11 can be locked or turned on the support body 2. Of the eight clamping devices 10 which are arranged in each support body 2, only a single one has been shown here. For turning the rolling rings 11 mounted on the support body 2, the clamping devices 10 are released (details being explained with reference to FIG. 4). The drive is effected via the drive unit 35 (details being explained with reference to FIG. 6) and a shaft 14 mounted in a recess 13 in the support body 2. The pinion 15 which is fastened on the shaft 14 is in engagement with one of the two drive pinions 16 which are fastened on a shaft 18 which extends in a hole 17 in the support body 2. These drive pinions 16 are in engagement with inner toothing 19 of the rolling rings 11.

Figure 4:
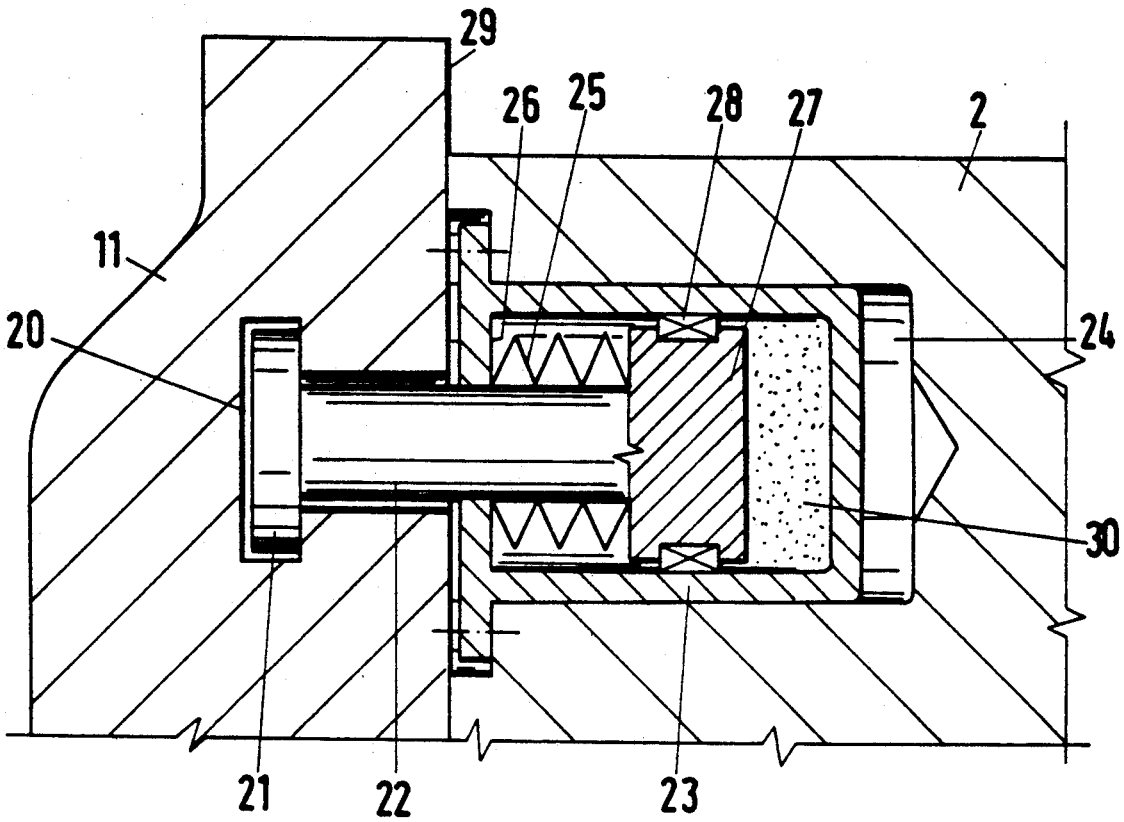
FIG. 4 is a clamping cylinder with disk springs.

FIG. 4 shows the clamping device. The rolling ring 11 has an annular groove 20 into which the head or the block 21 of the tensioning rod 22 engages. The tensioning rod 22 at the same time constitutes the piston rod of a clamping cylinder 23 which is arranged in a hole 24 in the support body 2. By means of the disk springs 25 which rest on one side against the inner wall 26 of the clamping cylinder 23 and on the other side against the piston 27 which is provided with a packing 28, the rolling ring 11 has its inner surface 29 pulled firmly against the support body 2. For turning the rolling rings 11, the cylinder chambers 30 are acted on by such a high pressure that the tensioning force of the disk springs 25 is overcome.

Figure 5:
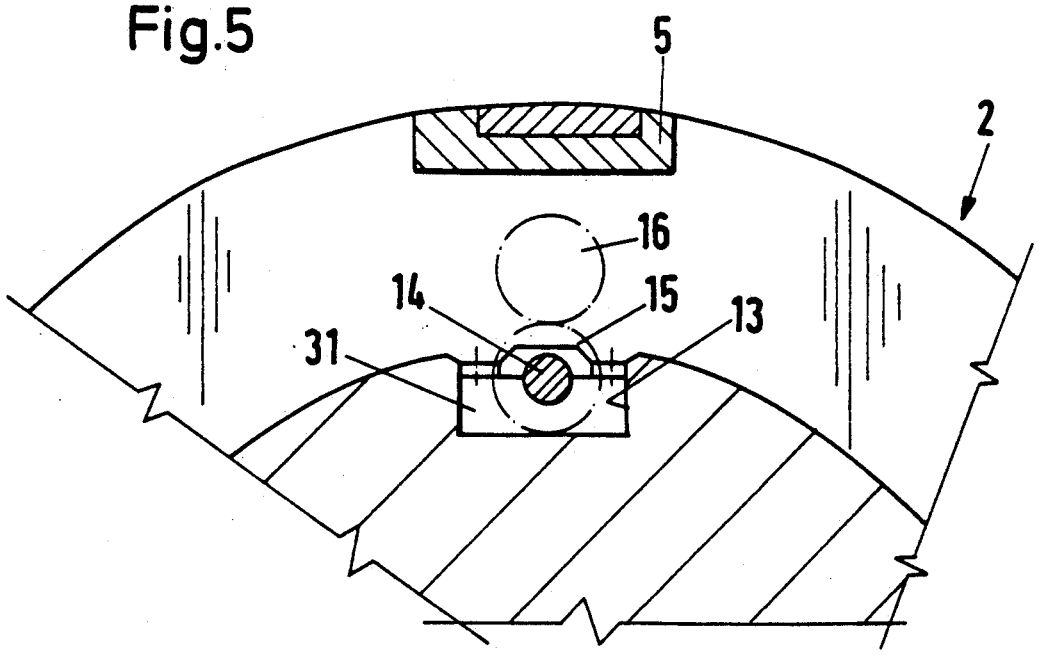
FIG. 5 shows the arrangement of the drive shaft.

FIG. 5 shows the arrangement of the shaft 14 in the recess 13 of the support body 2. A pedestal bearing is designated 31. There can furthermore be noted the pinion 15, a drive pinion 16 and a rolling segment 5.

The drive unit 35 (FIG. 6) consists of a stepping motor 32, which is flanged onto a hydraulic booster 33. The driven side of the hydraulic booster 33 is connected to a self- locking gearing 34 (for instance, a worm gearing).

It should be understood that the preferred embodiments and examples described are for illustrative purposes only and are not to be construed as limiting the scope of the present invention which is properly delineated only in the appended claims.

What is claimed is:

1. A roll stand for a planetary rolling mill comprising stationary support bodies with rolling segments mounted in chocks, and intermediate and work rolls mounted in cages and rotating around the support bodies, the chocks having a square basic shape, and each support body being provided with four rolling segments distributed uniformly on its periphery and being further provided at each end with a respective turnable rolling ring having a recess.

2. A roll stand according to claim 1, further comprising a turning device for turning the respective rolling rings of each support body with respect to the support body, and clamping devices for clamping the rolling rings against the support body.

3. A roll stand according to claim 2, wherein the rolling rings each has an inner toothing and the turning device comprises a stepping motor mounted outside the chocks, a hydraulic booster connected to the stepping motor, a self-locking gearing connected to the hydraulic booster, and a shaft extending in a hole in the support body and having drive pinions fastened on it.

4. A roll stand according to claim 2, wherein the clamping devices comprise clamping cylinders with disk springs that are arranged on the support bodies, and tensioning rods; the rolling rings having annular grooves to receive the tensioning rods on a surface facing the support body.

5. A roll stand according to claim 1, wherein each of the chocks is provided with a pair of ledges that are removably attached to the chocks in a position corresponding to the position of installation of the support bodies.

6. A roll stand according to claim 1, wherein the support bodies are provided on each end with pivot pins that extend outward beyond the chocks.

7. A roll stand for a planetary rolling mill comprising stationary support bodies with rolling segments mounted in chocks, and intermediate and work rolls mounted in cages and rotating around the support bodies, the chocks having an octagonal basic shape, and each support body being provided with eight rolling segments distributed uniformly on its periphery and being further provided at each end with a respective turnable rolling ring having a recess.

8. A roll stand according to claim 7, further comprising a turning device for turning the respective rolling rings of each support body with respect to the support body, and clamping devices for clamping the rolling rings against the support body.

9. A roll stand according to claim 8, wherein the rolling rings each has an inner toothing and the turning device comprises a stepping motor mounted outside the chocks, a hydraulic booster connected to the stepping motor, a self-locking gearing connected to the hydraulic booster, and a shaft extending in a hole in the support body and having drive pinions fastened on it.

10. A roll stand according to claim 8, wherein the clamping devices comprise clamping cylinders with disk springs that are arranged on the support bodies, and tensioning rods; the rolling rings having annular grooves to receive the tensioning rods on a surface facing the support body.

11. A roll stand according to claim 7, wherein each of the chocks is provided with a pair of ledges that are removably attached to the chocks in a position corresponding to the position of installation of the support bodies.

12. A roll stand according to claim 6, wherein the support bodies are provided on each end with pivot pins that extend outward beyond the chocks.

* * * * *